US010207893B2

(12) United States Patent
Elomaa et al.

(10) Patent No.: US 10,207,893 B2
(45) Date of Patent: Feb. 19, 2019

(54) ELEVATOR CALL ALLOCATION AND TRANSMISSION BASED ON A DETERMINATION OF WALKER SPEED

(71) Applicant: KONE Corporation, Helsinki (FI)

(72) Inventors: Niko Elomaa, Hyvinkää (FI); Jukka-Pekka Sarjanen, Vantaa (FI); Kenneth Kronkvist, Vantaa (FI)

(73) Assignee: KONE CORPORATION, Helsinki (FI)

( * ) Notice: Subject to any disclaimer, the term of this patent is extended or adjusted under 35 U.S.C. 154(b) by 400 days.

(21) Appl. No.: 15/087,303

(22) Filed: Mar. 31, 2016

(65) Prior Publication Data

US 2016/0207735 A1 Jul. 21, 2016

Related U.S. Application Data

(63) Continuation of application No. PCT/FI2013/050967, filed on Oct. 4, 2013.

(51) Int. Cl.
*B66B 1/18* (2006.01)
*B66B 1/24* (2006.01)
(Continued)

(52) U.S. Cl.
CPC ..... *B66B 1/2458* (2013.01); *B66B 1/3461* (2013.01); *B66B 1/3492* (2013.01);
(Continued)

(58) Field of Classification Search
CPC ... B66B 1/2458; B66B 1/3461; B66B 1/3492; B66B 1/468; B66B 13/146;
(Continued)

(56) References Cited

U.S. PATENT DOCUMENTS 3,972,021 A * 7/1976 Leitz ..... G08G 1/04 187/392
4,839,631 A * 6/1989 Tsuji ..... G08B 13/00 187/392
(Continued)

FOREIGN PATENT DOCUMENTS

CN 1639042 A 7/2005
CN 101056812 A 10/2007
(Continued)

*Primary Examiner* — Anthony Salata
(74) *Attorney, Agent, or Firm* — Birch, Stewart, Kolasch & Birch, LLP

(57) ABSTRACT

The invention relates to a method and apparatus. In the method a determining a first position of a user of a mobile node is determined at a first time instant. A second position of the user of the mobile node is determined at a second time instant. A time difference is determined between the first time instant and the second time instant. A walking speed of the user is determined using the time difference, the first position and the second position. A third position of the user of the mobile node is determined. A walking time required for the user to reach at least one elevator is determined from the third position based on the walking speed of the user. An elevator call and the walking time are transmitted to an elevator call control node.

20 Claims, 5 Drawing Sheets

Legend
114 - proximity card
140 - access control node
141 - access door
142, 144 - first and second proximity card readers
190 - photovoltaic sensor

(51) Int. Cl.
*B66B 1/34* (2006.01)
*B66B 13/14* (2006.01)
*B66B 1/46* (2006.01)

(52) U.S. Cl.
CPC ..... *B66B 1/468* (2013.01); *B66B 13/146* (2013.01); *B66B 2201/103* (2013.01); *B66B 2201/222* (2013.01); *B66B 2201/232* (2013.01)

(58) Field of Classification Search
CPC ..... B66B 2201/103; B66B 2201/222; B66B 2201/232
USPC ..... 187/247, 380–388, 391, 392, 393
See application file for complete search history.

(56) References Cited

U.S. PATENT DOCUMENTS 6,967,674 B1 * 11/2005 Lausch ..... G06K 9/00771 348/143
7,140,469 B2 * 11/2006 Deplazes ..... B66B 1/3476 187/316
7,712,586 B2 * 5/2010 Legez ..... B66B 1/20 187/387
7,822,227 B2 * 10/2010 Barnes ..... G01C 21/20 382/103
8,020,672 B2 * 9/2011 Lin ..... B66B 1/34 187/316
8,061,485 B2 * 11/2011 Finschi ..... B66B 1/468 187/384
8,584,811 B2 * 11/2013 Kuoppala ..... B66B 1/468 187/316
9,323,232 B2 * 4/2016 Blom ..... H04W 4/029
9,327,940 B2 * 5/2016 Hunninen ..... B66B 1/2491
9,873,590 B2 * 1/2018 Salmikuukka ..... B66B 3/006
2007/0041352 A1 2/2007 Frankel et al.
2013/0186713 A1 * 7/2013 Suzuki ..... B66B 1/2408 187/385

FOREIGN PATENT DOCUMENTS

EP 1873106 A1 1/2008
JP 2002-220177 A 8/2002
JP 2009-504529 A 2/2009
KR 10-0991477 B1 11/2010
WO WO 03/074405 A1 9/2003
WO WO 2008/116963 A1 10/2008

* cited by examiner

Legend

114 - proximity card

140 - access control node

141 - access door 142, 144 - first and second proximity card readers

190 - photovoltaic sensor

ELEVATOR CALL ALLOCATION AND TRANSMISSION BASED ON A DETERMINATION OF WALKER SPEED

BACKGROUND OF THE INVENTION

Field of the Invention

The invention relates to elevators, elevator allocation for a user, and a method and a system for elevator allocation based on a determination of walker speed.

Description of the Related Art

Even in buildings with less than ten floors, the correct allocation of elevator cars, that is, elevator cages to serve elevator calls from different floors is essential for quick response time and reduced time spent in travelling in the elevator. The time spent in the elevator is dependent on the number of intermediate floors visited and the time the elevator car doors are kept open. The problem is exacerbated in high rise buildings even though in high rise buildings the floors are usually serviced by short-distance and long-distance elevators so that only specific floors are accessible by the long-distance elevators. As is well known, elevator calls may be made from floors and from the elevator cars. An elevator call may be understood as a command for the elevator car to visit a specific floor. In modern elevator systems a user of the elevator may specify for the elevator the destination floor already when making the elevator call from a floor, that is, outside the elevator car. Herein the term elevator may be used to refer to the elevator car for simplicity. For improved elevator response time, it must be possible to minimize the time elevator car door are kept open. Naturally, closing the doors when there are still incoming passengers and there is still room in the elevator car is perceived as annoying. In present elevator systems the elevator users must come to a specific place where an elevator call keypad is located to make the elevator call. In many cases the keypad is directly in front of the elevators, but it may be also located at some distance from the elevators.

Access systems control access to a building and different areas within the building. Modern access systems rely on proximity cards that are brought to the vicinity of a proximity card reader. The proximity cards also serve as an identification of the cardholder. Therefore, it is possible to know where the cardholder is located at the instant of card reading. With the introduction of more powerful transmitters to the proximity cards, it becomes possible to just to pass a proximity card reader in order to read the proximity card.

In order to improve the service offered by an elevator system, it would be beneficial to be able to predict when an elevator user arrives at the elevators. It would also be beneficial to determine when the elevator user actually boards the elevator or whether the user is actually not going to arrive at the elevator as predicted. In this way it would be possible to ensure that elevator doors are not kept open too long.

SUMMARY OF THE INVENTION

According to an aspect of the invention, the invention is a method, comprising: determining a first position of a user of a mobile node at a first time instant, the first position being determined based on a proximity of a proximity card of the user to a first proximity card reader having a predetermined position; determining a second position of the user of the mobile node at a second time instant following the first time instant; determining a time difference between the first time instant and the second time instant; determining a walking speed of the user using the time difference, the first position and the second position; determining a third position of the user of the mobile node; determining a walking time required for the user to reach at least one elevator from the third position based on the walking speed of the user; and transmitting an elevator call and the walking time to an elevator call control node.

According to a further aspect of the invention, the invention is an apparatus comprising at least one processor and at least one memory including computer program code, the at least one memory and the computer program code configured to, with the at least one processor, cause the apparatus at least to perform: determining a first position of a user of a mobile node at a first time instant, the first position being determined based on a proximity of a proximity card of the user to a first proximity card reader having a predetermined position; determining a second position of the user of the mobile node at a second time instant following the first time instant; determining a time difference between the first time instant and the second time instant; determining a walking speed of the user using the time difference, the first position and the second position; determining a third position of the user of the mobile node; determining a walking time required for the user to reach at least one elevator from the third position based on the walking speed of the user; and transmitting an elevator call and the walking time to an elevator call control node.

According to a further aspect of the invention, the invention is an access control computer comprising the apparatus.

According to a further aspect of the invention, the invention is a mobile node comprising the apparatus.

According to a further aspect of the invention, the invention is an apparatus comprising means for determining a first position of a user of a mobile node at a first time instant, the first position being determined based on a proximity of a proximity card of the user to a first proximity card reader having a predetermined position; means for determining a second position of the user of the mobile node at a second time instant following the first time instant; means for determining a time difference between the first time instant and the second time instant; means for determining a walking speed of the user using the time difference, the first position and the second position; means for determining a third position of the user of the mobile node; means for determining a walking time required for the user to reach at least one elevator from the third position based on the walking speed of the user; and means for transmitting an elevator call and the walking time to an elevator call control node. The apparatus may be the mobile node or an access control node.

According to a further aspect of the invention, the invention is a computer program comprising code adapted to cause the following when executed on a data-processing system: determining a first position of a user of a mobile node at a first time instant, the first position being determined based on a proximity of a proximity card of the user to a first proximity card reader having a predetermined position; determining a second position of the user of the mobile node at a second time instant following the first time instant; determining a time difference between the first time instant and the second time instant; determining a walking speed of the user using the time difference, the first position and the second position; determining a third position of the user of the mobile node; determining a walking time required for the user to reach at least one elevator from the third position based on the walking speed of the user; and transmitting an elevator call and the walking time to an elevator call control node.

According to a further aspect of the invention, the invention is a computer program product comprising the computer program.

According to a further aspect of the invention, the invention is a method, comprising: determining a first position of a user of a mobile node at a first time instant; determining a second position of the user of the mobile node at a second time instant following the first time instant; determining a time difference between the first time instant and the second time instant; determining a walking speed of the user using the time difference, the first position and the second position; determining a third position of the user of the mobile node; determining a walking time required for the user to reach at least one elevator from the third position based on the walking speed of the user; and transmitting an elevator call and the walking time to an elevator call control node.

According to a further aspect of the invention, the invention is an apparatus comprising means for performing each of the method steps.

According to a further aspect of the invention, the invention is a computer program comprising code adapted to cause the performing of each of the method steps when executed on a data-processing system.

In one embodiment of the invention, the elevator car may also be referred to as elevator cage. The elevator car may be elevator cage.

In one embodiment of the invention, the mobile node comprises a near-field communication antenna, a near-field transmitter and/or a near-field receiver and a memory which may store person identifier or person number or a number of a proximity card. The memory may be part of a memory of the mobile node or a separate memory dedicated for near-field communication related data. The memory, the near-field communication antenna, the near-field transmitter and/or the near-field receiver may implement a proximity card apparatus or equipment in the mobile node, which may be referred to as the proximity card.

In one embodiment of the invention, the proximity of a proximity card of the user to a proximity card reader may be defined as a proximity which allows a signal to be correctly received by the proximity card reader from the proximity card.

In one embodiment of the invention, the mobile node comprises the proximity card. The proximity card comprised in the mobile node may be an active proximity card or a passive proximity card. The proximity card comprised in the mobile node may be a module or a unit that may comprise at least one of a proximity card antenna such as a coil antenna or a near-field communication antenna, a near-field transmitter and/or a near-field receiver, an integrated circuit which may store person identifier or person number or a number of the proximity card. The person identifier, the person number of the proximity card number may be used to identify the user of the mobile node. The proximity card module or unit may also comprise a processor and a memory for storing the person identifier or number. The proximity card module or unit may be powered from the battery of the mobile node or from a capacitor.

In one embodiment of the invention, the proximity card may be inserted in the mobile node as a removable module.

In one embodiment of the invention, the proximity card is attached to the mobile node or affixed to the mobile node.

In one embodiment of the invention, the third position may be the second position.

In one embodiment of the invention, the proximity card stores at least one of an identifier of the proximity card, a person identifier and a person number.

In one embodiment of the invention, the time difference is a time elapsed between the first time instant and the second time instant.

In one embodiment of the invention, the steps of determining of the first position of the user, determining of the second position of the user, determining of the time difference, and determining of the walking speed of the user are performed by the mobile node.

In one embodiment of the invention, the steps of determining of the first position of the user, determining of the second position of the user, determining of the time difference, and determining of the walking speed of the user are performed by the access control node.

In one embodiment of the invention, the determining of the third position of the user of the mobile node is performed by the mobile node. The determining of the third position of the user of the mobile node may be based on at least one inertial position measurement or a reception of a short-range radio signal by the mobile node. The short-range radio signal may be transmitted from a radio transmitter which is associated, for example, with a destination operator panel. The determining of the third position may be performed by the mobile node in response to receiving a near-field communication signal from a near-field transmitter. The near-field transmitter may be located close to or in association with a destination operator panel.

In one embodiment of the invention, the determining of the third position of the user of the mobile node is performed by the access control node. The determining of the third position may be based on a proximity of the proximity card of the user to a third proximity card reader having a predetermined position. The third proximity card reader may be located in close proximity to a destination operator panel or similar user interface, which may thereby allow the determining of the walking time required for the user to reach the at least one elevator from the destination operator panel or the similar user interface.

In one embodiment of the invention, the determining of the walking time required for the user to reach the at least one elevator from the third position based on the walking speed of the user may be performed by the mobile node or the access control node.

In one embodiment of the invention, the transmitting of the elevator call and the walking time to the elevator call control node may be performed by the mobile node or the access control node.

In one embodiment of the invention, the method further comprises performing a plurality of inertial position measurements in the mobile node, in response to the determination of the first position; determining a path or a distance the user has walked based on the first position, the second position and the plurality of inertial position measurements; and using the path or the distance, in addition to the time difference, in the determining of the walking speed of the user.

In one embodiment of the invention, the method further comprises performing a plurality of inertial position measurements in the mobile node, in response to the determination of the first position. The determining of the second position of the user of the mobile node at a second time instant may be comprised among the plurality of inertial position measurements.

In one embodiment of the invention, the determining of the second position of the user of the mobile node is performed in response to a condition, the condition being at least one of a determination that a predefined time has elapsed from the first time instant, a determination using at least one inertial position measurement that the user has walked a predefined distance from the first position, a determination using at least one positioning that the user has entered a predefined area in a floor, and a determination that the user has made an elevator call after the first time instant.

In one embodiment of the invention, the second position is determined based a proximity of the proximity card to a second proximity card reader having a predetermined position.

In one embodiment of the invention, an inertial position measurement is a determination of a position of the mobile node using an accelerometer or an accelerometer in combination with a gyroscope. The inertial position measurement stored in a memory or the mobile station may be associated with a timestamp of the time of the position determination.

In one embodiment of the invention, an access control node communicatively connected to the first proximity card reader and the second proximity card reader transmits a request to the mobile node to perform the plurality of inertial position measurements in the mobile node, in response to the determination of the first position. The access control node may recognize the user based on an identifier of the user stored in a proximity card carried by the user. The access control node may determine the first position and the second position based on messages from the first proximity card reader and the second proximity card reader, respectively.

In one embodiment of the invention, the determining a walking speed of the user using the time difference, the first position and the second position and the plurality of inertial position measurements may comprise determining whether the plurality of inertial position measurements indicate a meandering from a predefined path by the user or a stopping of the user. The predefined path is stored to a memory of the access control node and indicates a direct or an average path from the first proximity card reader and the second proximity card reader. In case of meandering or stopping the walking speed may not be determined.

In one embodiment of the invention, the determining a third position of the user of the mobile node is determined in response to reading the proximity card in a proximity of a third proximity card reader and the reporting of the proximity to the access control node by the third proximity card reader.

In one embodiment of the invention, the determining of the third position of the user of the mobile node is performed by an elevator call control node in response to receiving an elevator call via a destination operator panel. The destination operator panel may be configured to read a proximity card of the user via a proximity card reader in association with the destination operator panel. The destination operator panel may also comprise a short-range radio receiver configured to receive a short-range radio signal from the mobile node of the user.

In one embodiment of the invention, the determining of the third position of the user is performed by the access control node in response to a position report from the mobile node. The position report may be sent by the mobile node in response to detecting a predefined position defined to be tracked in association with a plurality of inertial position measurements performed by the mobile node. The predefined position may be provided to the mobile node from the elevator control node or the access control node via the mobile communication network.

In one embodiment of the invention, the transmitting of the elevator call may be performed by the access control node in response to detecting the proximity of the user at the third proximity card reader. The elevator call may be transmitted by the mobile node in response to detecting the third position in the mobile node or a message from the access control to the mobile node indicating the third position, in response to detecting the third position by the access control node, for example, by a third proximity card reader reading the proximity card of the user.

In one embodiment of the invention, the mobile node may receive information on the third position from the access control node or the elevator control node and the mobile node may store information on the third position. The mobile node may compare current positions to determine whether the mobile node is in the third position. The current positions may be determined based on a short-range radio receiver receiving a position indicator signal. The current position may be determined using inertial position measurements. The inertial position measurements may be performed in response to a determination of a predefined position from short-range radio transmitter received by the mobile node or in response to a message, for example, from the access control node, indicating that the mobile node is currently in a position having predefined position coordinates.

In one embodiment of the invention, the walking time may be transmitted to the elevator call control node by the access control node or by the mobile node.

In one embodiment of the invention, the method further comprises receiving, by the elevator call control node, the elevator call; receiving, by the elevator call control node, the walking time; and selecting, in the elevator call control node, an elevator car to serve the elevator call based on the walking time, a floor comprising the third position, current positions of at least two candidate elevator cars, and current directions of at the least two candidate elevator cars.

In one embodiment of the invention, the method further comprises transmitting information on the selected elevator car to at least one of the mobile node and a display from the elevator call control node.

In one embodiment of the invention, the method further comprises receiving the information on the selected elevator car in the mobile node; and indicating the selected elevator car on a display of the mobile node to the user.

In one embodiment of the invention, the method further comprises receiving the information on the selected elevator car in the display; and indicating the selected elevator car on the display to the user.

In one embodiment of the invention, the method further comprises recording a receiving time of the elevator call.

In one embodiment of the invention, the method further comprises detecting an entering of a person into the selected elevator car based on at least one photocell detector; verifying the entering of the person into the selected elevator car based on an elevator scale in the selected elevator car, the elevator scale indicating an increase in load, the increase exceeding a predefined minimum weight of a human; matching a time elapsed since the receiving time of the elevator call to the walking time; and determining, by the elevator call control node that the user has entered the selected elevator car.

In one embodiment of the invention, the method further comprises determining that there are no remaining users for which the elevator car has been selected in current floor, in response to the determining that the user has entered the selected elevator car; and closing doors of the selected elevator car.

In one embodiment of the invention, the method further comprises recording a plurality of second inertial position measurements using the mobile node of the user, in response to the determining of the third position of the user of the mobile node; comparing, by the mobile node, the plurality of the second inertial position measurements to a predefined route from the third position to the at least one elevator; and transmitting an elevator call cancelling request to the elevator control node, if the plurality of the second inertial position measurements indicate a deviation from the predefined route by the user or if the plurality of the second inertial position measurements indicate a stopping of the user.

In one embodiment of the invention, the method further comprises receiving information of the elevator call via a user interface to the mobile node, the information being received at the third position of the user of the mobile node.

In one embodiment of the invention, the method further comprises receiving information of the elevator call via a user interface from the user, the user interface being positioned at the third position.

In one embodiment of the invention, the step of determining the third position of the user of the mobile node comprises determining the third position based on a predefined position of the user interface.

In one embodiment of the invention, the user interface is a destination operator panel of the elevator call control node.

In one embodiment of the invention, the method further comprises transmitting, by the elevator call control node, to the mobile node, a request to record a plurality of second inertial position measurements.

In one embodiment of the invention, the method further comprises measuring a magnetic map of a floor using a magnetometer in the mobile node; storing the magnetic map to a memory of the mobile node; and determining the first, the second and the third position based on the magnetic map.

In one embodiment of the invention, the elevator call comprises information on the target floor and the selecting of the elevator car to serve the elevator call uses the target floor as a further criterion. The target floor is to be understood as the destination of the elevator ride for the user, the mobile node of which detects or makes the elevator call.

In one embodiment of the invention, the method further comprises transmitting a request to the elevator call control node associated with the selected elevator car, the request indicating the floor the elevator call was made in.

In one embodiment of the invention, the method further comprises indicating the selected elevator car to the user of the mobile node.

In one embodiment of the invention, the selected elevator car is indicated to the user of the mobile node using a display of the mobile node.

In one embodiment of the invention, the selected elevator car is indicated to the user of the mobile node using an external display within a predefined proximity from the mobile node.

In one embodiment of the invention, in the selection of the elevator car to serve the elevator call is used the time to reach a door of the elevator car from the elevator location. There may be multiple elevator locations within a floor. The elevator location cells may be located in front of, for example, a row or other spatial arrangement of the elevator shafts. The nearest elevator location to the third position where the elevator call may be made may be selected as the elevator location.

In one embodiment of the invention, by elevator car doors may also be meant floor doors preventing access to an elevator shaft. An elevator car itself may not have doors.

In one embodiment of the invention, the mobile node comprises at least one of a handset, a chipset, a mobile device and a mobile terminal.

In one embodiment of the invention, the access control node comprises an access control computer, for example, an access control server or an access control node.

In one embodiment of the invention, the at least one processor of the apparatus, for example, of the mobile node or the access control node may be configured to perform any of the method steps disclosed hereinabove.

In one embodiment of the invention, the access controller is configured to obtain via at least one of the first proximity card reader, the second proximity card reader, the third proximity card reader and a proximity card reader in association with a destination operator panel, at least one of an identifier of the proximity card, a person identifier and a person number from the proximity card, for example, from the memory of the proximity card or the integrated circuit of the proximity card.

In one embodiment of the invention, the mobile node such as a User Equipment (UE) comprises a mobile station or generally a mobile terminal. In one embodiment of the invention a user of a mobile terminal is identified using a subscriber module, for example, User Services Identity Module (USIM) or a Subscriber Identity Module (SIM). The combination of Mobile Equipment (ME) and a subscriber module may be referred to as a mobile subscriber or a mobile node. A mobile subscriber may be identified using an IMSI. An IP address may be allocated or associated with a mobile subscriber.

In one embodiment of the invention, the mobile node is configured to be used in a 4G system such as, for example, LTE Evolved Packet System (EPS).

In one embodiment of the invention, the computer program is stored on a non-transitory computer readable medium. The computer readable medium may be, but is not limited to, a removable memory card, a removable memory module, a magnetic disk, an optical disk, a holographic memory or a magnetic tape. A removable memory module may be, for example, a USB memory stick, a PCMCIA card or a smart memory card.

In one embodiment of the invention, an apparatus comprising at least one processor and at least one memory including computer program code, the at least one memory and the computer program code are configured to, with the at least one processor, cause the apparatus at least to perform a method according to any of the method steps.

The embodiments of the invention described hereinbefore may be used in any combination with each other. Several or at least two of the embodiments may be combined together to form a further embodiment of the invention. A method, an apparatus, a computer program or a computer program product to which the invention is related may comprise at least one of the embodiments of the invention described hereinbefore.

It is to be understood that any of the above embodiments or modifications can be applied singly or in combination to the respective aspects to which they refer, unless they are explicitly stated as excluding alternatives.

The benefits of the invention are related to improved elevator response time, reduced travel time in elevators and reduced energy consumption of an elevator system.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE EMBODIMENTS

Reference will now be made in detail to the embodiments of the present invention, examples of which are illustrated in the accompanying drawings.

Figure 1:
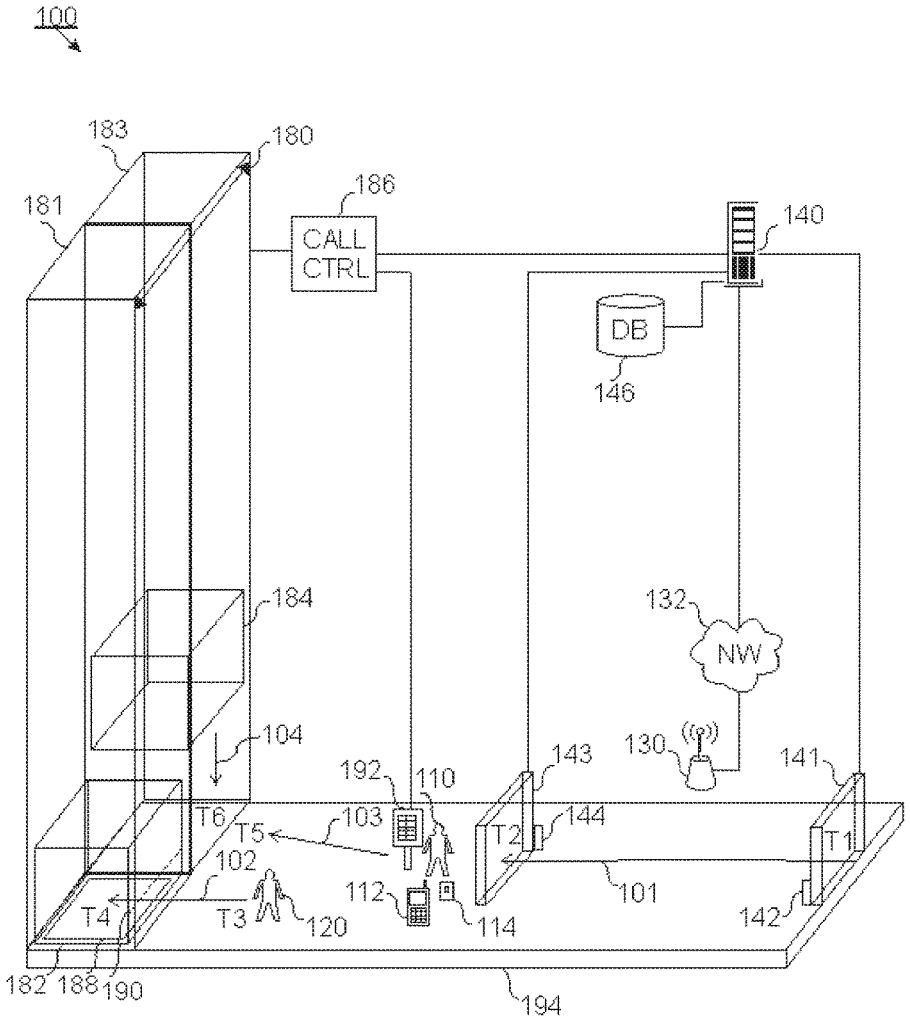
FIG. 1 illustrates a floor having an access control system and an elevator group of two elevators that utilize walking speed determination for elevator assignment in one embodiment of the invention.

FIG. 1 illustrates a floor having an access control system and an elevator group of two elevators that utilize walking speed determination for elevator assignment in one embodiment of the invention.

In FIG. 1 there is illustrated an elevator control system 100. The elevator control system controls an elevator group 180 comprising an elevator car 182 and an elevator car 184. The elevator cars 182 and 184 serve a floor 194. There are also other floors, but they are not shown for clarity reasons. The number of elevator cars, elevator groups and floor in FIG. 1 is just for illustrative purposes and may vary in different embodiments of the invention. FIG. 1 is not drawn to scale. Elevator cars 182 and 184 are installed in respective elevator shafts 181 and 183. Elevator car 182 may have at least one photovoltaic sensor 190 in an array which is configured to determine when a person enters the elevator. The determination may also verify that a light beam is broken for a sufficiently long time that indicates that a person has entered the elevator, for example, instead of a fly. Elevator car 182 may have elevator scales 188 which measure changes in the load of elevator car 182. An increase in the load that exceeds a predefined threshold may be considered to indicate that a person has entered elevator car 182. The elevator hoisting mechanism for elevator cars 182 and 184 is not shown for purposes of clarity. The elevator control system comprises an elevator call control node 186, in short call control node 186, which is communicatively connected to hoisting means associated with elevator cars 182 and 184. The hoisting means may comprise an electrical motor rotating a traction sheave and a drive control unit, which may be communicatively connected to call control node 186. Call control node 186 may be communicatively connected to a Destination Operator Panel (DOP) 192. DOP 192 comprises a user interface such as a keypad or a touch screen for indicating destination floors, destination floor groups, or destination directions by the user. Call control node 186 may also be communicatively connected to Car Operator Panels (not shown) in elevator cars 182 and 184. Call control node 186 may be communicative connected to access control node 140, which may control access to a plurality of areas in floor 194. Access control node 140 is communicatively connected to a first proximity card reader 142 and to a second proximity card reader 144, which may be components of access doors. First proximity card reader 142 may be associated with an access door 141 and second proximity card reader 144 may be associated with an access door 143. Access control node 140 may comprise a database 146 of walking speed determined for elevator passengers. The walking speed may be determined for different floors separately. Access control node 140 may be communicatively connected to a mobile communication network 132 which comprises a base station 130. Base station provides coverage for a mobile node 112 in the area of floor 194. Mobile node 112 is associated with a user, that is, a passenger 110. Passenger 110 is assumed to carry mobile node 112. Passenger 110 also carries a proximity card 114. In FIG. 1 access control node 140 may be configured to determine walking speeds for a plurality of passengers and to store the walking speeds determined in database 146. In one embodiment of the invention, mobile node 112 may be configured to determine walking time for passenger 110 and to store the walking time in a memory associated with mobile node 112. In FIG. 1 call control node 186 may be configured to receive in-formation on the walking speeds of each of the passengers in association with elevator calls for each of the passengers. Call control node 186 may obtain information on the walking speed for a passenger based on an inquiry of access control node 140 and database 146 by call control node 186. The inquiry comprises an identifier of at least one passenger such as a person identifier or a subscriber identifier of a mobile node. Call control node 186 may obtain information on the walking speed for a passenger in a message from a mobile node such as mobile node 112. The message may comprise a subscriber identifier of the mobile node or a person identifier such as a person number. The message may be in response to an inquiry sent by call control node 186 to mobile node 112. The walking speeds obtained may be used by call control node 186 to allocate a correct elevator among elevators 182 and 184 for each of the passengers, taking into consideration predicted arrival times of elevator cars 182 and 184 to floor 194 and a predefined maximum time for keeping the doors of an elevator car open while no further passengers enter the elevator car, a predefined maximum number of passengers in elevators cars 182 and 184.

The starting point in FIG. 1 is that passenger 110 is identified at time T1 using proximity card 114 at first proximity card reader 142, which may be located at access door 141. The access door may also be an access port or an access turnstile. It is assumed that passenger 110 carries mobile node 112 and proximity card 114, which stores an identifier of passenger 110 such as a person identifier or number. The person number may also be an identifier of proximity card 114. Mobile node 112 stores a subscriber identifier identifying passenger 110, for example, on a separate memory which may be associated with a removable subscriber module. The subscriber identifier may be, for example, a Mobile Station Integrated Services Digital Network (MSISDN) number, an International Mobile Subscriber Identifier (IMSI), a Uniform Resource Identifier (URI) or a telephone Uniform Resource Identifier (TEL-URI).

At time T1, an identifier of first proximity card reader 142 is transmitted to access control node 140, the transmission comprising an identifier of passenger 110, for example, a person identifier such as a person number. Access control node 140 may determine a position of first proximity card reader 142 based on the identifier of first proximity card reader 142, which may be mapped to a predetermined position of proximity card reader 142. Access control node 140 may determine current time T1 from an internal clock associated with access control node 140. At time T1, access control node 140 may transmit a message to mobile node 112 via mobile communication network 132 and base station 130. The message may request mobile node 112 to start performing inertial position measurements and to store the position measurements in a memory of mobile node 112 together with timestamps of the position measurements.

In one embodiment of the invention, mobile node 112 may be configured to recognize the position of first proximity card reader 142 based on a short-range radio signal from proximity card reader 142. Mobile node 112 may be configured to start performing inertial position measurements and to store the position measurements together with timestamps of the position measurements in a memory of mobile node 112 based on the short-range radio signal. Mobile node 112 may be configured to receive a request message from access control node 140 and, in response to the request message, start performing inertial position measurements and to store the position measurements together with timestamps of the position measurements in a memory of mobile node 112 based on the short-range radio signal.

Thereupon, passenger 110 walks to second proximity card reader 144, as illustrated with arrow 101. Second proximity card reader is located at access door 143. Access door 143 may be an access port or an access turnstile.

At time T2, passenger 110 is identified at second proximity card reader 144. At time T2, an identifier of second proximity card reader 144 is transmitted to access control node 140, the transmission comprising an identifier of passenger 110, for example, a person identifier such as a person number. Access control node 140 may determine a position of second proximity card reader 144 based on the identifier of second proximity card reader 144 which may be mapped to a predetermined position of proximity card reader 144. Access control node 140 may determine current time T2 from an internal clock associated with access control node 140. Access control node 140 determines the time difference between T1 and T2. At time T2, access control node 140 may transmit a message to mobile node 112 via mobile communication network 132 and base station 130. The message requests mobile node 112 to report the position measurements from the memory of mobile node 112. In response to a report comprising the position measurements, access control node 140 determines from the position measurements and the timestamps of the position measurements, if passenger 110 has stopped or meandered during the walk between first proximity card reader 142 and second proximity card reader 144 in which case the time difference does not qualify as a good approximation for walking speed determination, otherwise, access control node 140 uses the time difference together with information on the distance between the position of first proximity card reader 142 and the position of second proximity card reader 144 to determine a walking speed of passenger 110. Access control node 140 may also subtract from the time difference between T1 and T2 the times mobile node 112 has been at a standstill and passenger 110 has not moved in the computation of the walking speed.

In one embodiment of the invention, a position of mobile node 112 may be determined at time T2 without presence of second proximity card reader 144. Mobile node 112 may be positioned using at least one inertial position measurement performed by mobile node 112 between time instant T1 and time instant T2. The time T2 may be determined based on an elapsing of a predefined time after time instant T1 or based on a predefined distance walked by the user after time instant T1. The time T2 may be determined also in response to detecting that mobile node 112 enters a predefined area in floor 194.

In one embodiment of the invention, mobile node 112 may be configured to recognize the position of second proximity card reader 142 based on a short-range radio signal from proximity card reader 144. Mobile node 112 may be configured to retrieve the position measurements and the timestamps of the position measurements from the memory of mobile node 112. Mobile node 112 determines from the position measurements and the timestamps of the position measurements, if passenger 110 has stopped or meandered during the walk between first proximity card reader 142 and second proximity card reader 144 in which case the time difference does not qualify as a good approximation for walking speed determination, otherwise, access control node 140 uses the time difference together with information on the distance between the position of first proximity card reader 142 and the position of second proximity card reader 144 to determine a walking speed of passenger 110. Mobile node 112 may also subtract from the time difference between T1 and T2 the times mobile node 112 has been at a standstill and passenger 110 has not moved in the computation of the walking speed.

After time T2, either access control node 140 or mobile node 112 stores information on the walking speed of passenger 110. The information is stored in the memory of access control node 140 or mobile node 112. Thereupon, passenger 110 arrives to a position where an elevator call is made. The position may also be the position of the second proximity card reader 144. The elevator call may be made by passenger 110 using DOP 192 or using mobile node 112. In one embodiment of the invention, mobile node 112 makes the elevator call in response to determining a position where an elevator call is to be made on behalf of passenger 110. Mobile node 112 may determine the position where the elevator call is to be made using a short-range radio signal from a transmitter at the position. The position may also have a DOP such as DOP 192.

Thereupon, an elevator call is transmitted from DOP 192 or mobile node 112 to call control node 186. The elevator call identifies passenger 110 using a subscriber identifier of mobile node 112 or using a person identifier. DOP 192 may recognize passenger 110 using a proximity card reader in association with DOP 192, which reads proximity card 114 carried by passenger 110. In response to the elevator call, elevator control node 186 may enquire the walking speed from database 146 of access control node 140 using an identifier of passenger 110. The elevator call may also comprise a walking speed transmitted from mobile node 112.

Thereupon, call control node 186 has received the elevator call and the walking speed. Call control node 186 determines the distance between the position in which the elevator call is made by mobile node 112 or the position of DOP 192 and a position in front of elevator group 180. Call control node 186 determines a walking time based on the distance and the walking speed. Call control node 186 selects elevator car 182 or elevator car 184 to serve the elevator call based on the walking time, a floor comprising the position in which the elevator call is made, current positions of elevator cars 182 and 184, and current directions of elevator cars 182 and 184. Call control node 186 may have earlier determined walking time for a passenger 120 and allocated elevator car 182 for passenger 120.

At time T3, passenger 120 walks towards elevator car 182, which has been assigned to passenger 120 based on walking time from the position in which elevator call is made to a position in front of elevator group 180. It is assumed that elevator car 182 arrives earlier in floor 194 than elevator car 184. Therefore, passenger 120 who arrived earlier at the position in which elevator call is made and has a walking time substantially similar to the walking time of passenger 110, is assigned elevator car 182. The walking route for passenger 120 is illustrated with arrow 102.

At time T4, passenger 120 enters elevator car 182. The entry of passenger 120 may be verified with photovoltaic sensor 190 and may also be verified with elevator scales 188. The measurements from at least one photovoltaic sensor 190 and elevator scales 188 are transmitted to call control node 186, which verifies the entry of passenger 120. In one embodiment of the invention, elevator car 182 may also comprise a proximity card reader (not shown) that reads a proximity card held by passenger 120. The proximity card reader may transmit a signal to call control node 186 indicating that passenger 120 has arrived in elevator car 182. After the verification of entry of passenger 120, and after a further verification that no further passengers are currently assigned to elevator car 182, doors of elevator car 182 may be closed at a request from call control node 186.

At time T5, passenger 110 arrives to the position in front of elevator group 180, as illustrated with arrow 103. The arrival time T5 is too late to warrant the keeping of the doors of elevator car 182 open until time T5. Therefore, elevator car 182 is not assigned for passenger 110.

At time T6, elevator car 184 arrives in floor 194, as illustrated with arrow 104. After the doors of elevator car 184 are opened, passenger 110 may enter elevator car 184.

In one embodiment of the invention, call control node 186 comprises at least one processor and a memory. Call control node 186 may control at least one elevator or an elevator group based on elevator calls, which may be received via a car operator panel or a destination operator panel.

In one embodiment of the invention, access control node 140 comprises at least one processor and a memory. Access control node 140 may be configured to control at least one of an access door, an access port and an access turnstile. Access control node 140 may be configured to receive signals from at least one proximity card reader. Access control node 140 may store in a memory or a database access rights associated with a plurality of proximity cards. The access rights may indicate whether a particular door may be opened.

In one embodiment of the invention, call control node 186 and access control node 140 may be combined to a single network node, which may be implemented using a single server, computer unit or computer.

The embodiments of the invention described hereinbefore in association with the summary of the invention and FIG. 1 may be used in any combination with each other. At least two of the embodiments may be combined together to form a further embodiment of the invention.

Figure 2:
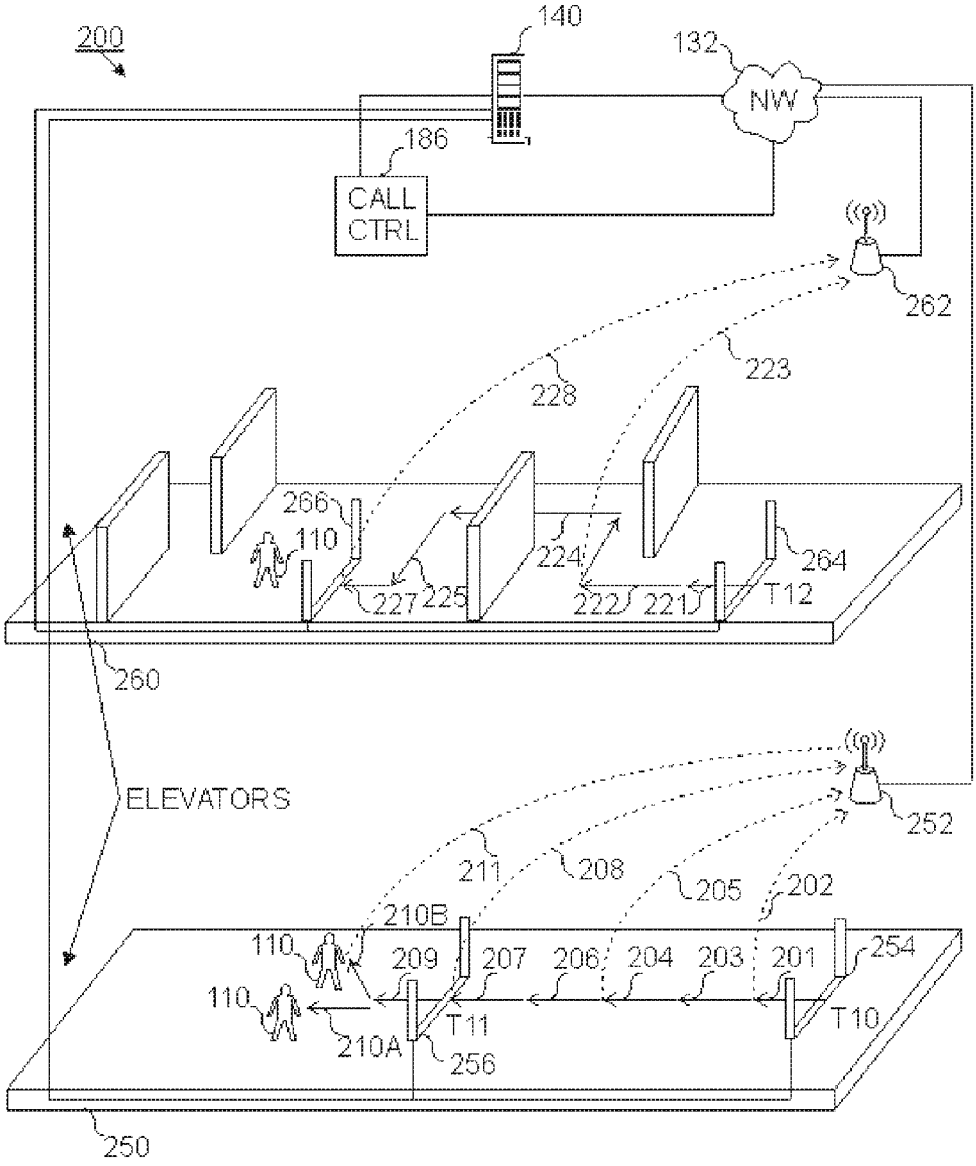
FIG. 2 illustrates two floors applying an access control system configured to perform walking speed determination for transmitting an elevator call in one embodiment of the invention.

FIG. 2 illustrates two floors applying a system 200 for access control and elevator call control configured to perform walking speed determination for transmitting an elevator call in one embodiment of the invention.

The system in FIG. 2 comprises access control node 140 and call control node 186, which are communicatively connected. Access control node 140 is communicatively connected to a mobile network 132 which comprises a base station 252 and a base station 262. Base station 252 provides radio coverage in the area of a floor 250, whereas base station 262 provides radio coverage in the area of a floor 260. Access control node 140 is communicatively connected to proximity card reader 254 and proximity card reader 256 in floor 250. Access control node 140 is as well communicatively connected to proximity card reader 264 and proximity card reader 266 in floor 250. Floor 260 is shown to have a longer walking route between proximity card reader 264 and proximity card reader 266 compared to walking route between proximity card reader 254 and proximity card reader 256 in floor 250. Similarly, walking route between proximity card reader 266 and elevators, which are assumed to be located on left side of floors 250 and 260 in FIG. 2, is longer in floor 260 compared to floor 250. Therefore, the mobile node of passenger 110 or access control node 140 must determine walking times separately for each floor. Similarly, the mobile node of passenger 110 or access control node 140 must determine separately for each floor the walking time to reach elevators from the point in which elevator call is made. In FIG. 2 the mobile node of passenger 110 reports inertial position measurements periodically or always when a certain number of inertial position measurements have been made to access control node 140 via base station 252 or base station 262 and mobile communication network 132.

Passenger 110 carrying her mobile node and her proximity card is shown in FIG. 1 to walk from proximity card reader 254 to proximity card reader 256 in the time period between times T10 and T11, as illustrated with arrows 201, 203, 204, 206 and 207. Passenger 110 enters through an access door and her proximity card is read by proximity card reader 254. In response to reading of her proximity card, the mobile node of passenger 110 receives a request to start performing inertial position measurements and to report them to access control node 140 periodically or after the performing of a predefined number of inertial position measurements. The request to start performing inertial position measurements may be received from access control node 140, in response to access control node 140 receiving a message from proximity card reader 254 that the proximity card of passenger 110 has been read. After the walking of walk 201, results of inertial position measurements performed in the mobile node are reported via base station 252 and mobile communication network 132 to access control node 140, as illustrated with arrow 202. After the walking of walks 203 and 204, results of inertial position measurements performed in the mobile node are reported via base station 252 and mobile communication network 132 to access control node 140, as illustrated with arrow 205. After the walking of walks 206 and 207, results of inertial position measurements performed in the mobile node are reported via base station 252 and mobile communication network 132 to access control node 140, as illustrated with arrow 208. At time T11, passenger 110 arrives at the position of proximity card reader 256 which is shown in association with an access door. In FIG. 2 it is assumed that at the position of proximity card reader 256 an elevator call is transmitted to call control node 186. The elevator call is transmitted by at least one of the mobile node of passenger 110, proximity card reader 256 and a DOP (not shown). The elevator call comprises information on a walking time computed by the mobile node or access control node 140 based on a walking speed determined for passenger 110 to walk from proximity card reader 254 to proximity card reader 256 and based on knowledge of walking distance from proximity card reader 256 to a position before elevators in floor 250. The walking distance is determined based on the inertial position measurements gathered during the walk from proximity card reader 254 to proximity card reader 256. The inertial position measurements contain information on the actual route and walking distance walked by passenger 110. The walking speed may be determined by the mobile node of passenger 110 or by access control node 140, either of which may have been informed by proximity card readers 254 and 256 on the events of reading the proximity card of passenger 110. The determination of walking speed also may utilize the walking distance determined in addition to time difference between times T10 and T11. Thereafter, passenger 110 walks the walk il-lustrated with arrow 209. Thereafter, passenger 110 either walks the walk illustrated with arrow 210A or the walk illustrated with arrow 210B. After walk 210B a report of inertial position measurements is transmitted by the mobile node to access control node 140, as illustrated with arrow 211. Due to the fact that passenger 110 has deviated from a predefined route to elevators in floor 250, access control node 140 transmits an elevator call can-cellation request to call control node 186. If passenger 110 walked instead walk 210A and a report of inertial position measurements was transmitted to access control node 140, the elevator call would not be cancelled since passenger 110 would then not have deviated from the predefined route.

In FIG. 2 passenger 110 carrying her mobile node and her proximity card is also shown to walk from proximity card reader 264 to proximity card reader 266 in the time period between times T12 and T13, as illustrated with arrows 221, 222, 224, 225 and 227. Reports of inertial position measurements performed by the mobile node of passenger 110 to access control node 140 are illustrated with arrows 223 and 228. In floor 260 the walking route to elevators and the walking route between proximity card readers 264 and 266 is shown to contain obstacles which may be seen to indicate that walking time may be computed for each floor separately. A walking time to elevators from the point of making the elevator call may vary depending on the walking routes available in different floors. In an office floor the walking time may be longer compared to an entrance floor due to longer walking route and possible repeated procedures while walking such as viewing a bulletin board.

Figure 3:
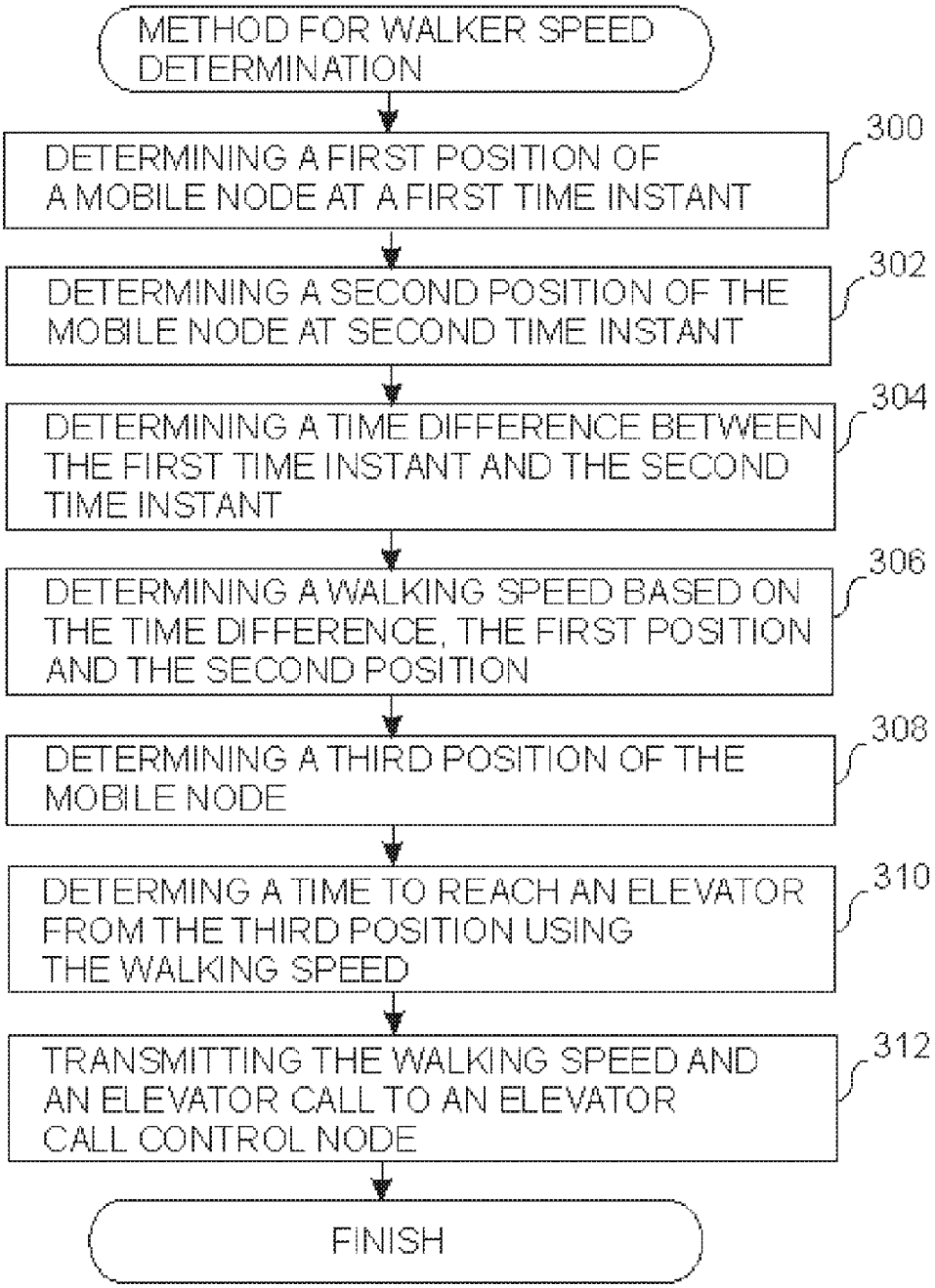
FIG. 3 is a flow chart illustrating a method for walking speed determination in one embodiment of the invention.

The embodiments of the invention described hereinbefore in association with FIGS. 1, 2 and 3 may be used in any combination with each other. Several of the embodiments may be combined together to form a further embodiment of the invention.

FIG. 3 is a flow chart illustrating a method for walking speed determination in one embodiment of the invention.

At step 300 there is determined a first position of a user of a mobile node at a first time instant. The first position may be determined based on proximity of a proximity card of the user to a first proximity card reader which has a predetermined position. The first position may be determined by the mobile node or by an access control node.

In one embodiment of the invention, the mobile node performs a plurality of inertial position measurements, in response to the determination of the first position. The performing of the plurality of the position measurements may be performed in response to a request from the access control node.

At step 302 there is determined a second position of the user of the mobile node at a second time instant.

In one embodiment of the invention, the second position may be determined based on proximity of the proximity card to a second proximity card reader having a predetermined position. The second position may be determined by the mobile node or by an access control node.

At step 304 there is determined a time difference between the first time instant and the second time instant. The determination may be performed by the mobile node or the access control node.

At step 306 there is determined a walking speed of the user using the time difference, the first position and the second position. The determination may be performed by the mobile node or the access control node. The determination may also be based on a plurality of inertial position measurements performed by the mobile node between the first time instant and the second time instant. The plurality of position measurement may indicate a distance walked by the user of the mobile node between the first time instant and the second time instant. In one embodiment of the invention, the walking speed of the user is determined based on the distance walked as indicated by the plurality of inertial position measurements.

In one embodiment of the invention, the determination comprises subtracting from the time difference durations of time periods during which the mobile node does not move. The time periods are determined based on the plurality of inertial position measurements. The subtraction may be performed by the mobile node or the access control node.

At step 308 there is determined a third position of the user of the mobile node.

In one embodiment of the invention, the determination may be performed in response to detecting a predefined position by the mobile node where an elevator call is to be made. The predefined position may be performed based on a proximity to a short-range radio transmitter to the mobile node.

In one embodiment of the invention, the determination may be performed in response to detecting in the access control node that the user of the mobile node is close to a destination operator panel used to make an elevator call. The detection may be performed using a proximity card reader in association with the destination operator panel.

In one embodiment of the invention, the determination may be performed in response to detecting in the access control node that the user of the mobile node is close to a third proximity card reader. The access control node is configured to receive a signal from the third proximity card reader in response to the third proximity card reader reading the proximity card of the user of the mobile node.

At step 310 there is determined a walking time required for the user to reach at least one elevator from the third position based on the walking speed of the user. The determination may be performed by the mobile node or the access control node.

At step 312 there is transmitted an elevator call and the walking time to an elevator call control node. The transmission may be performed by the mobile node or the access control node, in response to the determination of the third position of the user of the mobile node.

Thereupon, the method is finished. The method steps may be performed in the order of the numbering of the steps.

Figure 4:
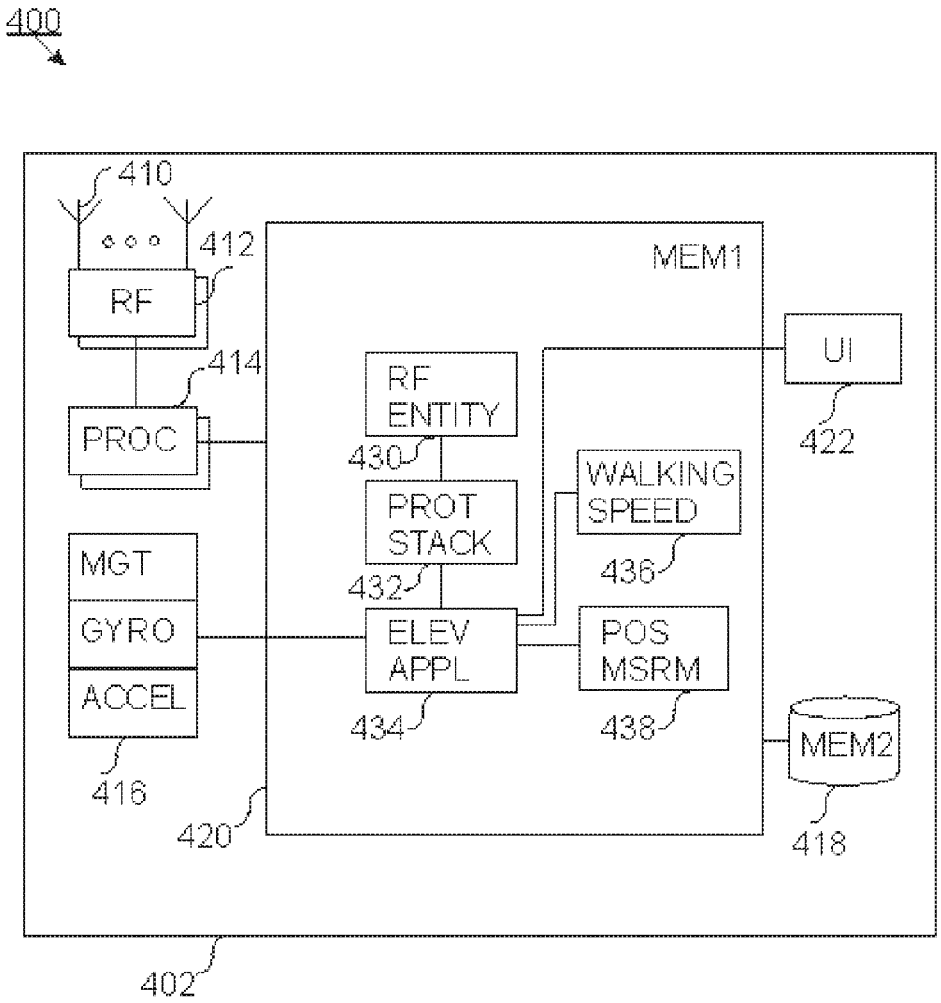
FIG. 4 is a block diagram illustrating a mobile node in one embodiment of the invention.

FIG. 4 is a block diagram illustrating an apparatus in one embodiment of the invention.

In FIG. 4 there is an apparatus 400, which is, for example, a mobile node, user equipment of a cellular system such as UMTS or LTE UE, a cellular system mobile station, an Application Specific Integrated Circuit (ASIC), a chip or a chipset. Apparatus 400 may correspond to a mobile node illustrated in FIGS. 1 and 2. The internal functions of apparatus 400 are illustrated with a box 402. Apparatus 400 may comprise at least one antenna 410. There may be multiple input and output antennas. In association with apparatus 400 there is at least one Radio Frequency (RF) circuit 412. RF circuit 412 may be also any circuit or may be referred to as circuit 412 or circuitry 412. RF circuit 412 may also comprise a baseband circuit. RF circuit 412 is communicatively connected to at least one processor 414. Connected to the at least one processor 414 there may be a first memory 420, which is, for example, a Random Access Memory (RAM). There may also be a second memory 418, which may be a non-volatile memory, for example, an optical or magnetic disk or a solid state disk. There is also a position and speed determination chip or circuit 416. Circuit 416 comprises a gyroscope and an accelerometer. Circuit 416 may also comprise a magnetometer. In memory 420 there may be stored software relating to functional entities 430, 432 and 434.

A protocol stack entity 432 communicates via an RF entity 430 with the at least one RF circuit 414 to perform signaling towards a base station and user data transmission and reception to/from the base station. An elevator application 434 obtains position and speed data of apparatus 400 from circuit 416. Elevator application 434 may store a data structure 436 in memory 420 which stores information on walking speed for different floors that may be identified based on current vertical position of mobile node 400. Elevator application 434 may store a data structure 438 in memory 420 which stores information on inertial position measurements performed using circuit 416 and time stamps of the measurements. Elevator application may transmit elevator calls to a remote node via protocol stack entity 432. The elevator call may be determined by the user giving the call via a user interface 422 of apparatus 400, for example, via a touchscreen or a keypad. The elevator call may be determined by elevator application 434 automatically, for example, when the user is in a predetermined position determined using a position recorded in memory 420 or when mobile node 400 detects a short-range radio signal.

RF circuit 412 may comprise a transmitter for SC-FDMA and a receiver and a transmitter for OFDMA. RF circuit 412 may also comprise a receiver for SC-FDMA. RF circuit 412 may also comprise a transmitter and a receiver circuit for WLAN transmission or reception.

When the at least one processor 414 executes functional entities associated with the invention, memory 420 comprises entities such as, any of the functional entities 430, 432 and 434.

Figure 5:
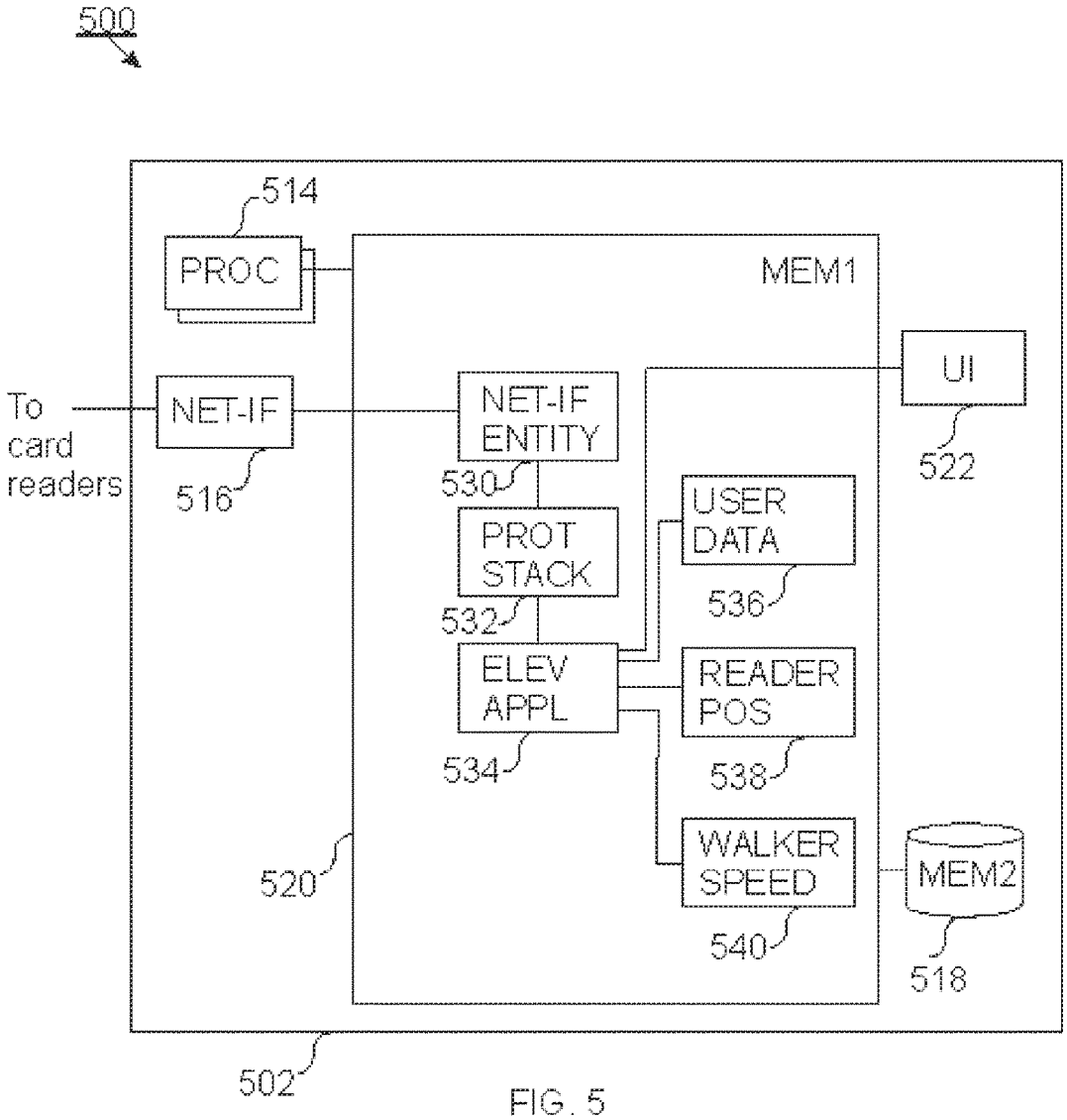
FIG. 5 is a block diagram illustrating an access control node in one embodiment of the invention.

FIG. 5 is a block diagram illustrating an apparatus in one embodiment of the invention.

In FIG. 5 there is an apparatus 500, which is, for example, an access control node, in short, an access control node such as illustrated in FIG. 1 or FIG. 2. An access control node may be a computer, a computer unit, a desktop computer, a laptop computer, a server or a blade server, a chip or a chipset. The internal functions of apparatus 500 are illustrated with a box 502. Apparatus 500 comprises at least one processor 514. Connected to the at least one processor 514 there may be a first memory 520, which is, for example, a Random Access Memory (RAM). There may also be a second memory 518, which may be a non-volatile memory, for example, an optical or magnetic disk or a solid state disk. Apparatus 500 also comprises a network interface 516, which may be, for example, an Ethernet card, a WLAN transceiver or a cellular network transceiver, for example, a wireless modem. Network interface 516 may be a wired or a wireless network interface card. Network interface 516 may be used to communicate with at least one proximity card reader and with an elevator call control node such as illustrated in FIGS. 1 and 2. Apparatus 500 also comprises a user interface 522. In memory 520 there may be stored software relating to functional entities 530, 532 and 534. A network interface entity 530 communicates with network interface 516. A protocol stack entity 532 communicates via a network interface entity 530 with remote network nodes such as the elevator call control node or the at least one proximity card reader. An access application 534 may communicate with the at least one proximity card reader, the elevator call control node and a mobile node such as mobile node 112 in FIG. 1. Access application 534 may store user data in a data structure 536. Data structure 536 may store user access rights data to different areas, for example, different parts in a building or a set of buildings. Access application 534 may also store data to a data structure 538 which stores data on predefined positions of at least one proximity card reader. Access application 534 may store a data structure 540 which stores information on walking speeds of different users. Access application may store different walking speeds for at least two different floors. Access application 534 may transmit elevator calls to a remote node via protocol stack entity 532.

In one embodiment of the invention, apparatus 500 initiates determining of a first position of a user of a mobile node at a first time instant. This may comprise that apparatus 500 requests a first proximity card reader to inform when the first proximity card reader reads a proximity card of the user of the mobile node. The determination of the first position may be performed by the proximity card reader communicating with apparatus 500. Thereupon, apparatus 500 may transmit a request to a mobile node to perform a plurality of inertial position measurements. Thereupon, apparatus 500 initiates determining a second position of the user of the mobile node at a second instant. This may comprise that apparatus 500 request a second proximity card reader to inform when the second proximity card reader reads the proximity card of the user of the mobile node. Apparatus 500 may determine the positions of the first and the second proximity card reader from data structure 538. Apparatus 500 may determine a time difference between the first time instant and the second time instant. Apparatus 500 may also receive a plurality of inertial position measurements from the mobile node of the user. Thereupon, apparatus 500 may determine a walking speed of the user using the time difference, the first position and the second position and, optionally, the plurality of inertial position measurements. Thereupon, apparatus 500 initiates determining a walking time required for the user to reach at least one elevator from the third position based on the walking speed of the user. Thereupon, apparatus 500 initiates transmitting an elevator call and the walking time to an elevator call control node.

When the at least one processor 514 executes functional entities associated with the invention, memory 520 comprises entities such as, any of the functional entities 530, 532 and 534.

The functional entities within apparatuses 400 and 500 illustrated in FIGS. 4 and 5 may be implemented in a variety of ways. They may be implemented as processes executed under the native operating system of the network node. The entities may be implemented as separate processes or threads or so that a number of different entities are implemented by means of one process or thread. A process or a thread may be the instance of a program block comprising a number of routines, that is, for example, procedures and functions. The functional entities may be implemented as separate computer programs or as a single computer program comprising several routines or functions implementing the entities. The program blocks are stored on at least one computer readable medium such as, for example, a memory circuit, memory card, magnetic or optical disk. Some functional entities may be implemented as program modules linked to another functional entity. The functional entities in FIG. 4 may also be stored in separate memories and executed by separate processors, which communicate, for example, via a message bus or an internal network within the network node. An example of such a message bus is the Peripheral Component Interconnect (PCI) bus.

The embodiments of the invention described hereinbefore in association with FIGS. 1, 2, 3, 4, 5 or the summary of the invention may be used in any combination with each other. Several of the embodiments may be combined together to form a further embodiment of the invention.

The exemplary embodiments of the invention can be included within any suitable device, for example, including any suitable servers, workstations, PCs, laptop computers, PDAs, Internet appliances, handheld devices, cellular telephones, wireless devices, other devices, and the like, capable of performing the processes of the exemplary embodiments, and which can communicate via one or more interface mechanisms, including, for example, Internet access, telecommunications in any suitable form (for instance, voice, modem, and the like), wireless communications media, one or more wireless communications networks, cellular communications networks, 3G communications networks, 4G communications networks, Long-Term Evolution (LTE) networks, Public Switched Telephone Network (PSTNs), Packet Data Networks (PDNs), the Internet, intranets, a combination thereof, and the like.

It is to be understood that the exemplary embodiments are for exemplary purposes, as many variations of the specific hardware used to implement the exemplary embodiments are possible, as will be appreciated by those skilled in the hardware art(s). For example, the functionality of one or more of the components of the exemplary embodiments can be implemented via one or more hardware devices, or one or more software entities such as modules.

The exemplary embodiments can store information relating to various processes described herein. This information can be stored in one or more memories, such as a hard disk, optical disk, magneto-optical disk, RAM, and the like. One or more databases can store the information regarding cyclic prefixes used and the delay spreads measured. The databases can be organized using data structures (e.g., records, tables, arrays, fields, graphs, trees, lists, and the like) included in one or more memories or storage devices listed herein. The processes described with respect to the exemplary embodiments can include appropriate data structures for storing data collected and/or generated by the processes of the devices and subsystems of the exemplary embodiments in one or more databases.

All or a portion of the exemplary embodiments can be implemented by the preparation of one or more application-specific integrated circuits or by interconnecting an appropriate network of conventional component circuits, as will be appreciated by those skilled in the electrical art(s).

As stated above, the components of the exemplary embodiments can include computer readable medium or memories according to the teachings of the present inventions and for holding data structures, tables, records, and/or other data described herein. Computer readable medium can include any suitable medium that participates in providing instructions to a processor for execution. Such a medium can take many forms, including but not limited to, non-volatile media, volatile media, transmission media, and the like. Non-volatile media can include, for example, optical or magnetic disks, magneto-optical disks, and the like. Volatile media can include dynamic memories, and the like. Transmission media can include coaxial cables, copper wire, fiber optics, and the like. Transmission media also can take the form of acoustic, optical, electromagnetic waves, and the like, such as those generated during radio frequency (RF) communications, infrared (IR) data communications, and the like. Common forms of computer-readable media can include, for example, a floppy disk, a flexible disk, hard disk, magnetic tape, any other suitable magnetic medium, a CD-ROM, CDRW, DVD, any other suitable optical medium, punch cards, paper tape, optical mark sheets, any other suitable physical medium with patterns of holes or other optically recognizable indicia, a RAM, a PROM, an EPROM, a FLASH-EPROM, any other suitable memory chip or cartridge, a carrier wave or any other suitable medium from which a computer can read.

While the present inventions have been described in connection with a number of exemplary embodiments, and implementations, the present inventions are not so limited, but rather cover various modifications, and equivalent arrangements, which fall within the purview of prospective claims.

The embodiments of the invention described hereinbefore in association with the figures presented and the summary of the invention may be used in any combination with each other. Several of the embodiments may be combined together to form a further embodiment of the invention.

It is obvious to a person skilled in the art that with the advancement of technology, the basic idea of the invention may be implemented in various ways. The invention and its embodiments are thus not limited to the examples described above; instead they may vary within the scope of the claims.

The invention claimed is:

1. A method, comprising:

determining a first position of a user of a mobile node at a first time instant, the first position being determined based on a proximity of a proximity card of the user to a first proximity card reader having a predetermined position;

determining a second position of the user of the mobile node at a second time instant following the first time instant, wherein the determining of the second position of the user of the mobile node is performed in response to a condition, the condition being at least one of a determination that a predefined time has elapsed from the first time instant, a determination using at least one inertial position measurement that the user has walked a predefined distance from the first position, a determination using at least one positioning that the user has entered a predefined area in a floor, and a determination that the user has made an elevator call after the first time instant;

determining a time difference between the first time instant and the second time instant;

determining a walking speed of the user using the time difference, the first position and the second position;

determining a third position of the user of the mobile node;

determining a walking time required for the user to reach at least one elevator from the third position based on the walking speed of the user; and transmitting the elevator call and the walking time to an elevator call control node.

2. The method according to claim 1, wherein the second position is determined based a proximity of the proximity card to a second proximity card reader having a predetermined position.

3. The method according to claim 1, the method further comprising:

receiving, by the elevator call control node, the elevator call;

receiving, by the elevator call control node, the walking time; and selecting, in the elevator call control node, an elevator car to serve the elevator call based on the walking time, a floor comprising the third position, current positions of at least two candidate elevator cars, and current directions of at the least two candidate elevator cars.

4. The method according to claim 3, the method further comprising:

transmitting information on the selected elevator car to at least one of the mobile node and a display.

5. The method according to claim 4, the method further comprising:

receiving the information on the selected elevator car in the mobile node; and indicating the selected elevator car on a display of the mobile node to the user.

6. The method according to claim 4, the method further comprising:

receiving the information on the selected elevator car in the display; and indicating the selected elevator car on the display to the user.

7. The method according to claim 3, the method further comprising:

recording a receiving time of the elevator call.

8. The method according to claim 7, the method further comprising:

detecting an entering of a person into the selected elevator car based on at least one photocell detector;

verifying the entering of the person into the selected elevator car based on an elevator scale in the selected elevator car, the elevator scale indicating an increase in load, the increase exceeding a predefined minimum weight of a human;

matching a time elapsed since the receiving time of the elevator call to the walking time; and determining, by the elevator call control node that the user has entered the selected elevator car.

9. The method according to claim 8, the method further comprising:

determining that there are no remaining users for which the elevator car has been selected in current floor, in response to the determining that the user has entered the selected elevator car; and closing doors of the selected elevator car.

10. The method according to claim 1, the method further comprising:

recording a plurality of inertial position measurements using the mobile node of the user, in response to the determining of the third position of the user of the mobile node;

comparing, by the mobile node, the plurality of the second inertial position measurements to a predefined route from the third position to the at least one elevator; and transmitting an elevator call cancelling request to the elevator control node, if the plurality of the second inertial position measurements indicate a deviation from the predefined route by the user or if the plurality of the second inertial position measurements indicate a stopping of the user.

11. The method according to claim 1, the method further comprising:

receiving information of the elevator call via a user interface to the mobile node, the information being received at the third position of the user of the mobile node.

12. The method according to claim 1, the method further comprising:

receiving information of the elevator call via a user interface from the user, the user interface being positioned at the third position.

13. The method according to claim 12, wherein the step of determining the third position of the user of the mobile node comprises:

determining the third position based on a predefined position of the user interface.

14. The method according to claim 12, wherein the user interface is a destination operator panel of the elevator call control node.

15. The method according to claim 12, the method further comprising:

transmitting, by the elevator call control node, to the mobile node, a request to record a plurality of inertial position measurements.

16. The method according to claim 1, the method further comprising:

performing a plurality of inertial position measurements in the mobile node, in response to the determination of the first position;

determining a path the user has walked based on the first position, the second position and the plurality of inertial position measurements; and using the path in the determining of the walking speed of the user.

17. An apparatus comprising at least one processor and at least one memory including computer program code, the at least one memory and the computer program code configured to, with the at least one processor, cause the apparatus at least to perform:

determining a first position of a user of a mobile node at a first time instant, the first position being determined based on a proximity of a proximity card of the user to a first proximity card reader having a predetermined position;

determining a second position of the user of the mobile node at a second time instant following the first time instant, wherein the determining of the second position of the user of the mobile node is performed in response to a condition, the condition being at least one of a determination that a predefined time has elapsed from the first time instant, a determination using at least one inertial position measurement that the user has walked a predefined distance from the first position, a determination using at least one positioning that the user has entered a predefined area in a floor, and a determination that the user has made an elevator call after the first time instant;

determining a time difference between the first time instant and the second time instant;

determining a walking speed of the user using the time difference, the first position and the second position;

determining a third position of the user of the mobile node;

determining a walking time required for the user to reach at least one elevator from the third position based on the walking speed of the user; and transmitting the elevator call and the walking time to an elevator call control node.

18. A computer program embodied on a non-transitory computer readable medium comprising code adapted to cause the following when executed on a data-processing system:

determining a first position of a user of a mobile node at a first time instant, the first position being determined based on a proximity of a proximity card of the user to a first proximity card reader having a predetermined position;

determining a second position of the user of the mobile node at a second time instant following the first time instant, wherein the determining of the second position of the user of the mobile node is performed in response to a condition, the condition being at least one of a determination that a predefined time has elapsed from the first time instant, a determination using at least one inertial position measurement that the user has walked a predefined distance from the first position, a determination using at least one positioning that the user has entered a predefined area in a floor, and a determination that the user has made an elevator call after the first time instant;

determining a time difference between the first time instant and the second time instant;

determining a walking speed of the user using the time difference, the first position and the second position;

determining a third position of the user of the mobile node;

determining a walking time required for the user to reach at least one elevator from the third position based on the walking speed of the user; and transmitting the elevator call and the walking time to an elevator call control node.

19. The computer program according to claim 18, wherein said computer program is stored on a non-transitory computer readable medium.

20. The method according to claim 2, the method further comprising:

receiving, by the elevator call control node, the elevator call;

receiving, by the elevator call control node, the walking time; and selecting, in the elevator call control node, an elevator car to serve the elevator call based on the walking time, a floor comprising the third position, current positions of at least two candidate elevator cars, and current directions of at the least two candidate elevator cars.

* * * * *